US005350905A

United States Patent [19]

Choi

[11] Patent Number: 5,350,905

[45] Date of Patent: Sep. 27, 1994

[54] MAGNETRON FOR A MICROWAVE OVEN

[75] Inventor: Byoung T. Choi, Kyungsangbook, Rep. of Korea

[73] Assignee: Goldstar Co., Ltd., Rep. of Korea

[21] Appl. No.: 978,485

[22] Filed: Nov. 19, 1992

[30] Foreign Application Priority Data

Nov. 20, 1991 [KR] Rep. of Korea ..... 19970/1991

[51] Int. Cl.[5] ..... H05B 6/64; H01J 25/50

[52] U.S. Cl. ..... 219/761; 315/39.61; 315/39.55

[58] Field of Search ..... 219/10.55 B, 10.55 R, 219/761, 746, 748; 315/39.51, 39.55, 39.57, 39.59, 39.61, 39.69, 39.75, 39.77

[56] References Cited

U.S. PATENT DOCUMENTS

| | | | |
|---|---|---|---|
| 3,792,306 | 2/1974 | Smith et al. | 315/39.57 |
| 4,109,179 | 8/1978 | McKinnon | 315/39.75 |
| 4,331,935 | 5/1982 | Thornber | 315/39.61 |
| 4,743,805 | 5/1988 | Takada | 315/39.75 |
| 4,831,341 | 5/1989 | Brady | 315/39.61 |
| 5,049,782 | 9/1991 | Alga et al. | 315/39.51 |
| 5,090,613 | 2/1992 | Lee | 228/254 |

*Primary Examiner*—Philip H. Leung

*Attorney, Agent, or Firm*—Ostrolenk, Faber, Gerb & Soffen

[57] ABSTRACT

In a magnetron for a microwave oven comprising a plurality of vanes as an anode and an antenna feeder mounted to the vanes, an antenna feeder fixing device comprising a plurality of radially spaced grooves formed at the upper surface of every other vane so that the antenna feeder is engaged with one of the grooves selected depending on the output of the magnetron. The antenna feeder fixing device can be applied to various models of magnetrons having different outputs, without changing the construction of vanes. This enables modular elements to be used for providing various models of magnetrons, irrespective of different outputs of magnetrons. Only one mold is needed for preparing a single vane construction having a plurality of grooves for various magnetron models, thereby enabling the manufacture cost to decrease.

2 Claims, 5 Drawing Sheets

MAGNETRON FOR A MICROWAVE OVEN

BACKGROUND OF THE INVENTION

1. Field of the Invention

The present invention relates to a magnetron for a microwave oven, and more particularly to an antenna feeder fixing device for such a magnetron.

2. Description of the Prior Art

Referring to FIG. 1, there is illustrated an example of a conventional magnetron for a microwave oven. FIG. 2 is a sectional view of a vacuum body of the magnetron shown in FIG. 1. As shown in FIGS. 1 and 2, the magnetron comprises a hollow cathode shield body 1 and a filament 2 disposed in the cathode shield body 1 and adapted to emit thermions. The cathode shield body 1 is disposed in a hollow magnetron body constituted by an upper member 5 of a plate shape and a lower member 6 of a cylindrical shape. The cathode shield body 1 also has upper and lower portions protruded beyond upper and lower members 5 and 6, respectively. To seal and support the cathode shield body 1, an A-seal member 3 and an F-seal member 4 are provided at the upper and lower portions of the cathode shield body 1. Around the filament 2, a plurality of vanes 7 are placed to receive microwave energy generated when the thermions emitted from the filament 2 are acceleratively rotated in an interaction spacer 9 which is defined between the wall of the cathode shield body i and the filament 2. The magnetron also comprises an antenna feeder 8 adapted as a microwave transfer path for guiding microwave energy received by the vanes 7 into a cooking chamber of the microwave oven. The antenna feeder 8 is supported to the upper member 5 of magnetron body by the A-seal member 3. In the magnetron body, upper and lower permanent magnets 10 and 10' are attached to upper and lower members 5 and 8, respectively, to generate a magnetic field. The magnetic field is transferred to the interaction space 9, by means of pole pieces 11 and 11'. Around the cathode shield body 1, a plurality of cooling fins 12 are disposed which function to release outwardly heat generated in the interaction space 9 and thus cool the interior of cathode shield body 1. Strap rings are also provided for adjusting frequencies of the thermions rotating acceleratively in the interaction space 9. The strap rings are fitted in strap grooves 25 formed at a desired portion of each vane 7. A center lead 17 and a side lead 18 are supported to the lower member 6 of magnetron body by means of the F-seal member 4 and extend downwardly beyond the cathode shield body 1. The central lead 17 and side lead 18 are connected at their one ends to both ends of the filament 2, respectively, so as to apply electric power to the filament 2. A choke coil 15 is also provided to remove conductive noise generated by lead current. To the other ends of leads 17 and 18, a through type condenser 14 is connected, which functions as a terminal making it possible to apply easily electric power from the external to the filament 2. The condenser 14 cooperates with the chock coil 15 to enhance a shield effect on conductive noise. Beneath the housing, a filter box 13 is disposed to surround the lower portion of the cathode shield body 1. The filter box 13 functions to remove radiation noise emitting through both the center lead 17 and the side lead 18.

In this conventional magnetron with the above-mentioned construction, a magnetic circuit is formed along the upper member 5, the lower member 8 and the pole pieces 11 and 11', by the electric field of permanent magnets 10 and 10' so that a magnetic field is generated in the interaction space 9. Under this condition, as electric power is applied to the filament 2 via the center lead 17 and the side lead 18, an electric field is generated between the filament 2 as a cathode and the vanes 7 as an anode, thereby causing the filament 2 to emit thermions which are, in turn, radiated into the interaction space 9. In the interaction space 9, the thermions conduct a cycloidal movement, that is, an accelerated rotation, by axial magnetic fluxes generated from the pole pieces 11 and 11' and an electric field generated between the filament 2 and the vanes 7. On the other hand, microwave energy transmitted to the vanes 7 is fed into the cooking chamber, via the antenna feeder 8 and a waveguide (not shown) of the oven, thereby heating the food placed in the cooking chamber.

On the other hand, it has been known that in the above-mentioned magnetron, the distance between the antenna feeder 8 and the wall of cathode shield body 1 is one of factors causing a variation in output of the magnetron. In this regard, various magnetrons having different outputs have been conventionally provided by varying the distance between the antenna feeder 8 and the wall of cathode shield body 1 according to the model of magnetron.

FIG. 3 is a plan view showing the cathode shield body and vanes of the conventional magnetron. On the other hand, FIG. 4 is a perspective view of the vanes of the conventional magnetron. As shown in FIGS. 3 and 4, a plurality of vanes 7 are formed to extend radially toward the central axis of the cathod shield body 1. Every other vane 7 has at its upper surface a groove 16 for engaging with the antenna feeder 8. Each vane 7 also has stepped strap grooves 25 at its upper and lower surfaces, respectively. In the stepped strap grooves 25, strap rings are fitted, respectively.

Each groove 16 is spaced apart from the inner wall surface of cathode shield body 1 by a constant distance d. As a result, the antenna feeder 8 which is engaged with the groove 16 is also spaced apart from the inner wall surface of cathode shield body 1 by the constant distance d.

It is known that the output of magnetron is increased upon an increase in the distance d and decreased upon a decrease in the distance d.

In the above-mentioned construction, however, there is a disadvantage that the distance d between the antenna feeder and the inner wall surface of cathode shield body 1 is always constant, because only one groove 16 is provided at the upper surface of every other vane 7 of the cathode shield body 1. As a result, this type of vanes 7 can not be applied to other models of magnetrons having different outputs.

That is, where a magnetron having a different output is desired to be manufactured, there is a requirement of a different type of vanes having different groove position. This causes a difficulty in using modular elements for providing various models of magnetrons. As a result, it is required to prepare various molds for forming respective vanes for various magnetron models, thereby causing the manufacture cost to increase.

SUMMARY OF THE INVENTION

Therefore, an object of the invention is to eliminate the above-mentioned disadvantages encountered in the prior art and to provide an antenna feeder fixing structure capable of being applied to various models of magnetrons having different outputs, without changing the construction of vanes.

In accordance with the present invention, this object can be accomplished by providing a magnetron for a microwave oven comprising a plurality of vanes as an anode, an antenna feeder mounted to the vanes, wherein the vanes includes a plurality radially spaced grooves for selectively fixing the antenna feeder at the upper surface of every other vane and adjusting the desired magnetron output by the selection thereof.

A plurality of radially spaced grooves are formed at an upper surface of each of selected ones of the vanes so that the antenna feeder is engaged with one of the grooves selected corresponding to the output of the magnetron.

The antenna feeder fixing structure can be applied to various models of magnetrons having different outputs, without changing the construction of vanes. This enables modular elements to be used for providing various models of magnetrons, irrespective of different outputs of magnetrons. Furthermore, only one mold is needed for preparing a single vane construction having a plurality of grooves for various magnetron models, thereby enabling the manufacture cost to decrease.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
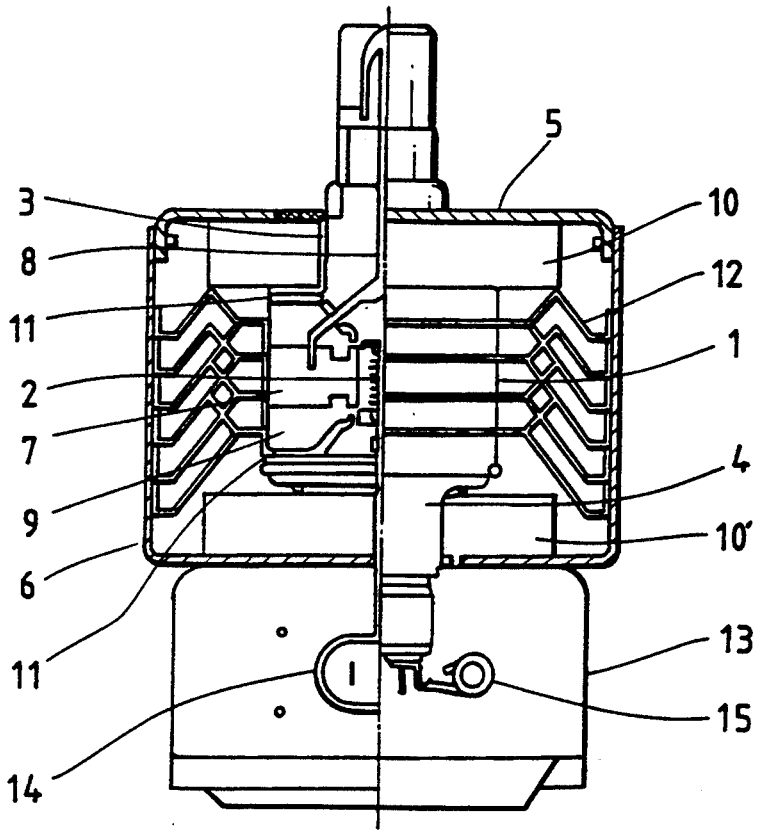
FIG. 1 PRIOR ART
FIG. 1 is a partially sectioned side view of a conventional magnetron for a microwave oven.
Figure 2:
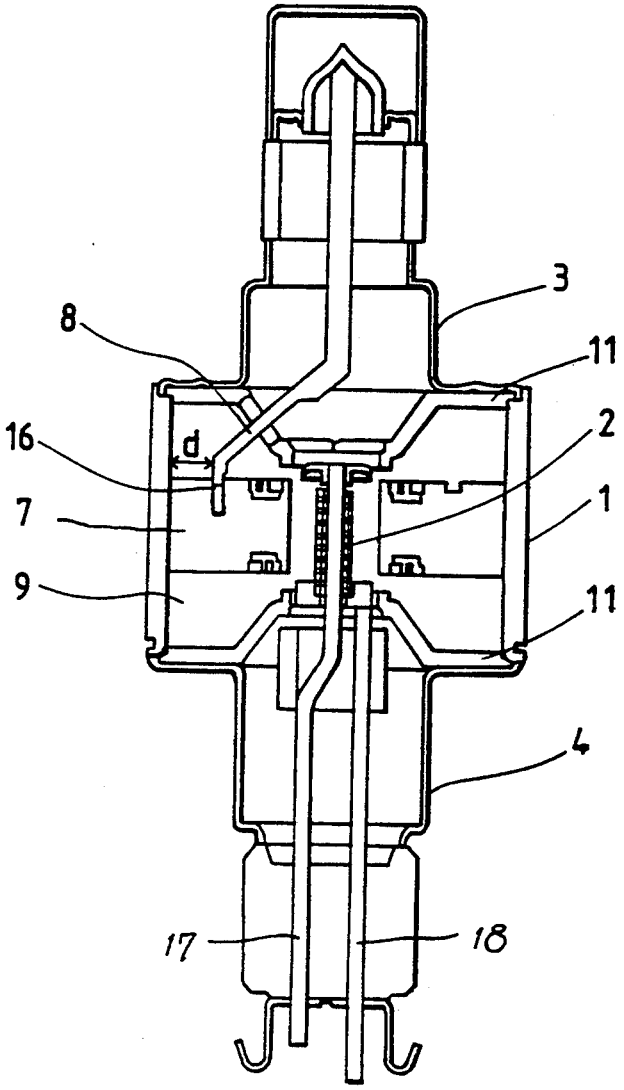
FIG. 2 PRIOR ART
FIG. 2 is a sectional view of a vacuum body of the magnetron shown in FIG, 1.
Figure 3:
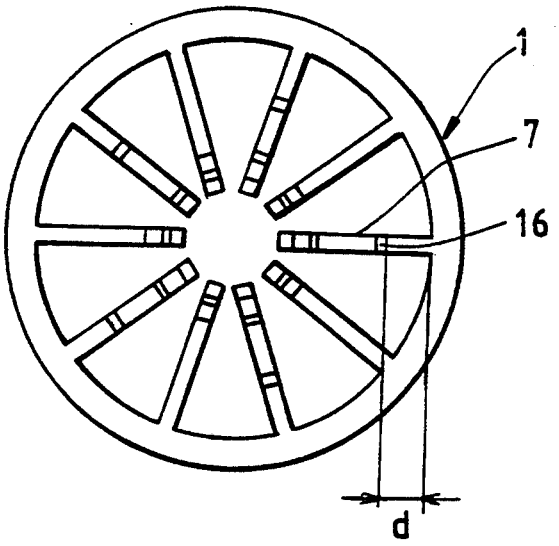
FIG. 3 PRIOR ART
FIG. 3 is a plan view showing the cathode shield body and vanes of the conventional magnetron.
Figure 4:
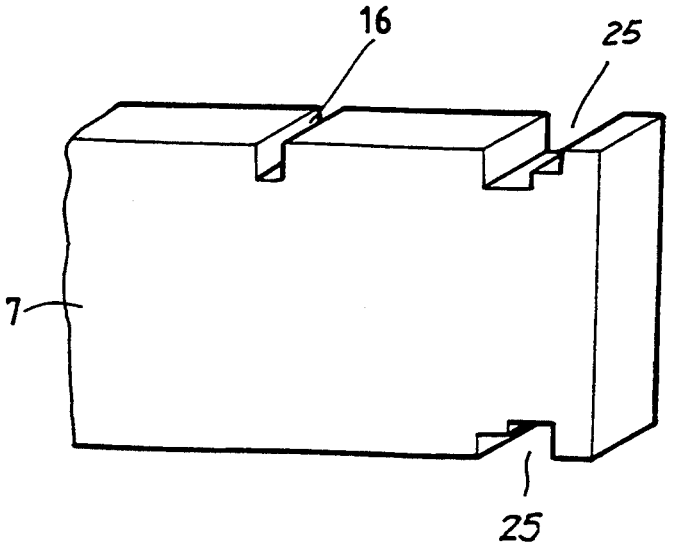
FIG. 4 PRIOR ART
FIG. 4 is a perspective view of the vanes of the conventional magnetron.
Figure 5:
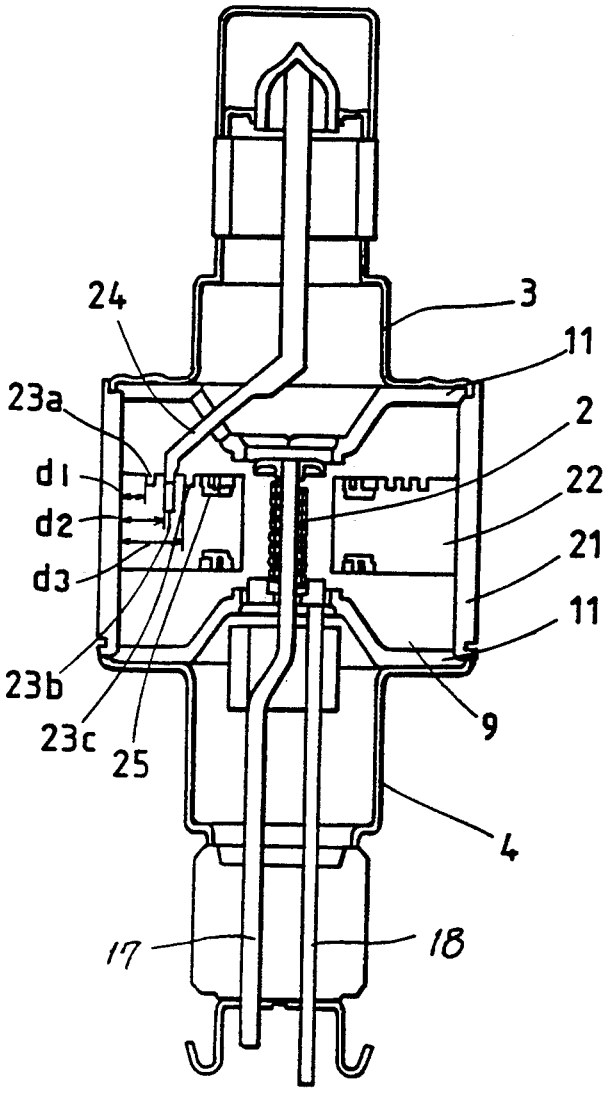
FIG. 5 is a sectional view of a vacuum body constituting a magnetron for a microwave oven in accordance with the present invention.
Figure 6:
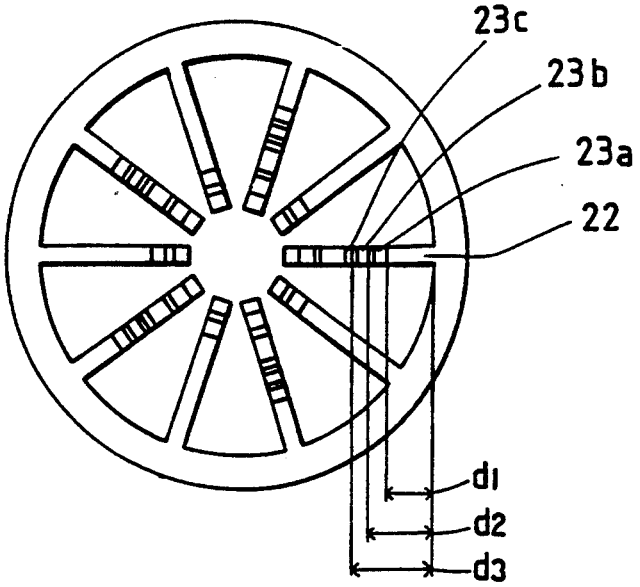
FIG. 6 is a plan view of constructions of a cathode shield body and vanes in accordance with the present invention.
Figure 7:
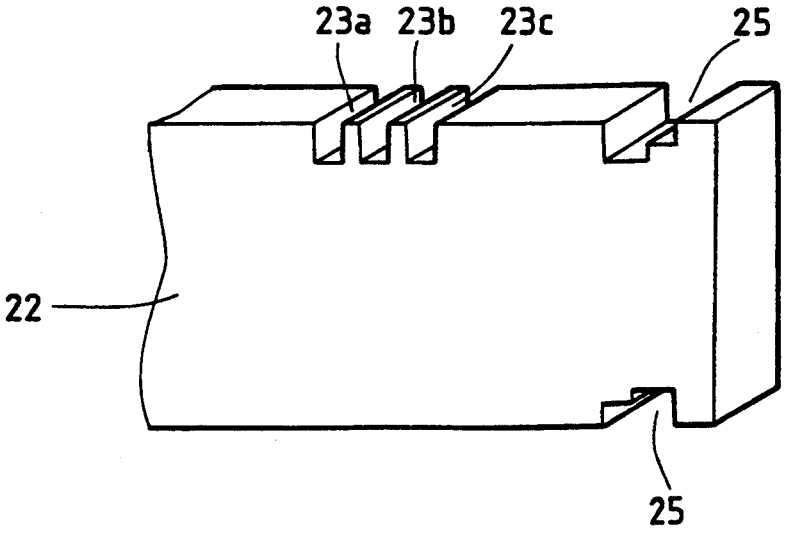
FIG. 7 is a perspective view of the construction of one vane in accordance with the present invention.

Referring to FIGS. 5 to 7, there is illustrated a magnetron with an antenna feeder fixing device according to the present invention. FIG. 5 is a sectional view of a vacuum body constituting a magnetron for a microwave oven in accordance with the present invention, FIG. 6 is a plan view of constructions of a cathode shield body and vanes in accordance with the present invention. On the other hand, FIG. 7 is a persepective view of the construction of one vane in accordance with the present invention a plurality of grooves 23*a*, 23*b* and 23*c* provided on the upper surface of vanes, as illustrated in FIG. 7, constitute the antenna feeder fixing structure. The magnetron shown in FIGS. 5 to 7 has the same construction as that shown in FIGS. 1 to 4, except for an antenna feeder fixing structure. Accordingly, the same constituting elements are denoted by the same reference numerals and their detailed description is omitted.

As shown in FIGS. 5 to 7, the magnetron of the present invention comprises a cathode shield body 21 in which a plurality of vanes 22 are disposed to extend radially from the inner wall surface of the cathode shield body 21. Near to its end, each vane 22 has at its upper and lower surfaces stepped strap grooves 25 for fitting strap rings (not shown) therein, respectively.

Several grooves 23, 23' and 23'' spaced radially are formed at the upper surface of every other vane 22, for fixing an antenna feeder 24. The antenna feeder 24 is engaged with selected one of the grooves 23, 23' and 23'', in order to select a desired magnetron output.

In the illustrated embodiment, respective distances of the grooves 23, 23' and 23'' from the inner wall surface of cathode shield body 21 are d1, d2 and d3. Depending on the model of magnetron having a desired output, one is selected from the distances d1 to d3, which selected one corresponds to a desired distance between the antenna feeder 24 and the inner wall surface of cathode shield body 21.

Although the number of grooves is three in the illustrated embodiment, it is not limited thereto and may be four or more.

In this magnetron with the above-mentioned construction, a magnetic circuit is formed along the upper member 5, the lower member 8 and the pole pieces 11 and 11' by the electric field of permanent magnets 10 and 10' so that a magnetic field is generated in the interaction space 9, in similar to the conventional construction. An electric field is also generated between the filament 2 as a cathode and the vanes 22 as an anode, thereby causing the filament 2 to emit thermions which are, in turn, radiated into the interaction space 9. In the interaction space 9, the thermions are changed into electron energy, that is, microwave energy. The microwave energy is then fed into an output unit, that is, a cooking chamber, via the antenna feeder 24.

As apparent from the above description, the present invention provides an antenna feeder fixing structure for a magnetron wherein a plurality of radially spaced grooves are formed at every other vane so that one selected therefrom according to the output of magnetron is engaged with an antenna feeder, thereby capable of being applied to various models of magnetrons having different outputs, without changing the construction of vanes. This enables modular elements to be used for providing various models of magnetrons, irrespective of different outputs of magnetrons. Furthermore, only one mold is needed for preparing a single vane construction having a plurality of grooves for various magnetron models, thereby enabling the manufacture cost to decrease.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A magnetron for a microwave oven comprising a plurality of vanes as an anode, an antenna feeder mounted to the vanes, and a plurality of radially spaced grooves on the vanes for enabling selective fixing of said antenna feeder at a desired position and for obtaining a desired magnetron output by the selection of said grooves.

2. The magnetron of claim 1, wherein three of said grooves are provided at an upper surface of each of the vanes.

* * * * *